United States Patent [19]

Harmon

[11] 4,281,228

[45] Jul. 28, 1981

[54] TOOL FOR MAKING AND BREAKING LOAD CURRENTS

[76] Inventor: Robert W. Harmon, Rte. 4, Centralia, Mo. 65240

[21] Appl. No.: 25,903

[22] Filed: Apr. 2, 1979

[51] Int. Cl.[3] ..... H01H 3/54; H01H 9/16; H01H 9/30

[52] U.S. Cl. ..... 200/51 R; 200/145; 200/308; 200/321

[58] Field of Search ..... 339/19, 222; 200/51 R, 200/51.02, 51.07, 51.12, 144 B, 145, 308, 321, 318, 322, 327

[56] References Cited

U.S. PATENT DOCUMENTS

| | | | |
|---|---|---|---|
| 2,233,826 | 3/1941 | Allison | 200/51 R |
| 2,438,746 | 3/1948 | Garrison | 200/51 R |
| 2,863,026 | 12/1958 | Jennings | 200/144 B |
| 3,038,980 | 6/1962 | Lee | 200/144 B |
| 3,259,875 | 7/1966 | Evers | 339/222 |
| 3,471,669 | 10/1969 | Curtis | 200/302 |
| 3,887,254 | 6/1975 | Landis et al. | 339/222 |

OTHER PUBLICATIONS

A. B. Chance Co. Temporary Load Break Load Pick--Up Vacuum Switching Tool Instruction Manual.

*Primary Examiner*—John W. Shepperd

[57] ABSTRACT

A portable tool for making and breaking high magnitude load currents is provided which is reliable in operation, can be used in applications lacking mechanical switching or cutout apparatus, and provides a secondary, visual assurance to the user when a load is broken. The device preferably includes a pair of vacuum bottle-enclosed, load-making and -breaking contacts, along with a series-connected pair of visually observable contacts exteriorly of the vacuum bottle. Spring-biased operating mechanism assures that the bottle-enclosed contacts actually make and break the load current during use of the tool, while the secondary contacts are operated in sequenced relationship to the make and break contacts. When the device is used to break a current load, transparent portions of the tubular walls of the device permit the user to visually perceive a large open air gap between the secondary contacts.

4 Claims, 13 Drawing Figures

TOOL FOR MAKING AND BREAKING LOAD CURRENTS

BACKGROUND OF THE INVENTION

1. Field of the Invention

The present invention is concerned with a portable load making and breaking tool especially adapted for use by utility linemen working in and around high voltage transmission and distribution equipment. More particularly, it is concerned with such a load making and breaking device which provides a reliable make and break function by virtue of vacuum-enclosed electrical contacts, and further includes secondary, series-connected contacts constructed such that the user can visually observe a large air gap between the secondary contacts when the latter are open.

2. Description of the Prior Art

During work and repair of electrical transmission and distribution lines, it is often very desirable to make and/or break electrical loads. That is to say, in many instances it is preferred to disconnect or connect a system under load, i.e., while current is passing therethrough. Load making and breaking allows work to be done on a portion of a distribution system, for example, with a minimium of unnecessary outages to unaffected customers. Additionally, such work can be performed under much safer working conditions when the load is properly broken.

Generally speaking, load breaking cannot be realistically accomplished simply through the use of mechanical switches and the like. This for the reason that attempts to break load currents in this fashion cause arcing between the switch contacts during the opening sequence, which in turn can damage such equipment. Thus, specialized devices have heretofore been provided for load breaking which serve to positively break the load without equipment damage.

In electrical distribution systems, a series of switches and/or cutout units are usually provided for sectionalizing the system. Cutouts are fused for circuit protection, and also can be opened manually should the need arise in order to open the section or sections of the circuit protected by the cutout. As noted above however, conventional cutout and/or switches cannot generally be used for circuit making and breaking under load. Thus, it has been the practice to make or break the load at an upstream position or the like having specialized equipment for this purpose; however, this is undesirable in that a large portion of the distribution system is affected, even though only a minor portion thereof needs attention. In order to overcome this problem, devices have been provided for attachment in parallel to cutouts or switches which serve to break a current load passing therethrough. One such device is commercialized under the designation "Loadbuster." In the use of such a device, the latter is placed in parallel with a cutout or switch, and the equipment is manually opened. At this point the load breaking device is actuated to break the current load without damage to the cutout or switch. The "Loadbuster" unit is deficient, however, inasmuch as it is incapable of making a load. Moreover, in order to be used, it must be mounted onto and in parallel with a cutout or other mechanical switchgear. Thus, it is useless in situations such as when a spur line is connected to a main transmission or distribution line simply by the use of a short stretch of interconnecting conductor and without any mechanical cutouts or switchgear interposed therein. Finally, the expulsion principle of operation of this unit makes it less than optimum from the standpoint of safety and reliability. Further, it cannot safely be used with rubber gloves alone; hot stick operation is required.

In short, there is a need for a portable load making and breaking device which has universal applicability in that it can be used in contexts wherein no mechanical connect-disconnect apparatus is employed.

In order for any load make or break device to be truly useful, it must not only be reliable in practice, but must be reasonably safe in operation. This in turn means that the device must be capable of quickly suppressing any arcing which may occur during load making and breaking operations. Furthermore, linemen and others concerned with safe practices have expressed a strong preference for devices of this character which give a positive visual assurance of a load break. As can be appreciated, any prudent linemen would be very hesitant to work around supposedly unenergized electrical equipment without first assuring himself that the circuit had indeed been opened.

SUMMARY OF THE INVENTION

The load making and breaking tool of the present invention is preferably portable to facilitate use thereof and advantageously includes a pair of electrical load-making and -breaking contacts along with mechanism for selectively and alternately closing and opening the contact pair to thereby correspondingly make and break an electrical current path through the device. Means is also provided for suppressing arcing between the contacts during opening and closing operations, and in the preferred form of the invention includes a vacuum bottle for reliable arc suppression. Finally, connection structure is provided adjacent the opposed ends of the device for allowing the latter to be temporarily connected between a pair of conductors.

In more preferred forms, the invention further includes a second pair of contacts in series with the load making and breaking contacts. The opening and closing mechanism also includes means for breaking a load current passing through the series-connected contact pairs, when both of the latter are closed, by sequentially opening the first contact pair and thereafter opening the second contact pair. During current making operations, when both of the contact pairs are initially opened, the second contact pair is closed first, whereupon the load making and breaking contact pair is closed. Also, the tool is constructed so as to allow the user to visually observe the second contact pair in their open condition, so that the user is assured of a positive load break.

DESCRIPTION OF THE PREFERRED EMBODIMENT

Figure 1:
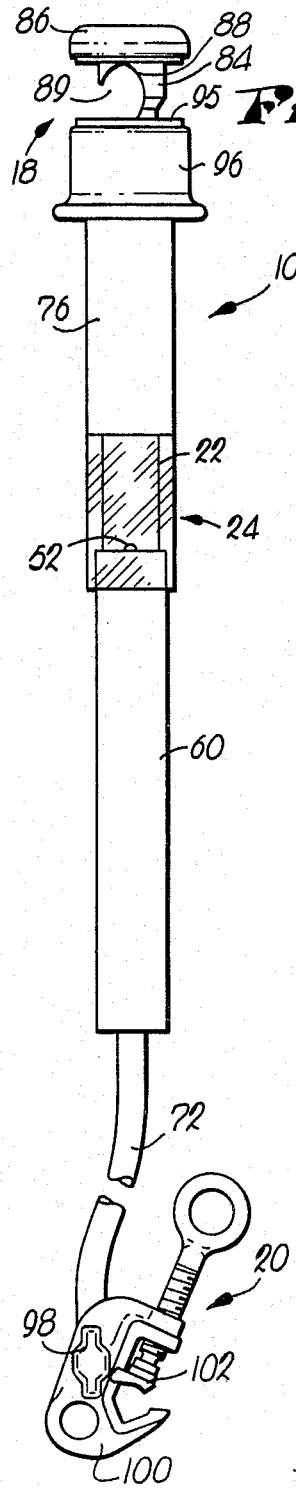
FIG. 1 is a fragmentary elevational view of a tool in accordance with the invention, shown in a load break condition.

Referring now to the drawings, a tool 10 in accordance with the invention broadly includes a first pair of electrical load making and breaking contacts 12, a second or additional pair of contacts 14 in electrical series relationship with the pair 12, operating mechanism broadly referred to by the numeral 16, and structure 18 and 20 respectively disposed adjacent the opposite ends of the tool for temporarily electrically connecting the latter between a pair of conductors as will be described.

Figure 2:
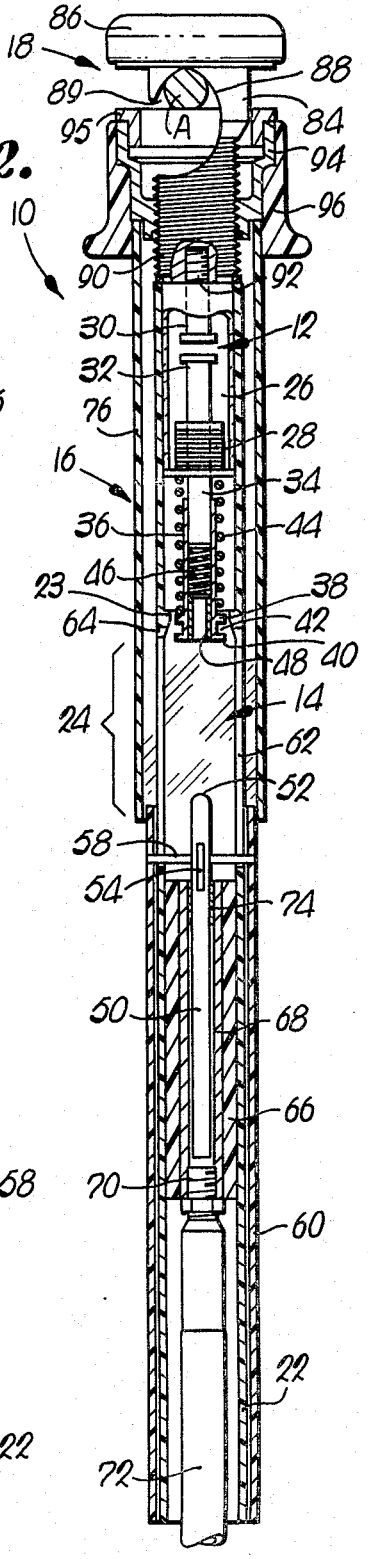
FIG. 2 is a fragmentary vertical sectional view with parts broken away for clarity of the tool illustrated in FIG. 1 connected to a conductor.

In more detail, tool 10 includes an elongated, axially slotted first tubular member 22 having a radially inwardly extending camming shoulder 23 an an elongated transparent portion 24. A vacuum bottle 26 is fixedly disposed within the tubular member 22 adjacent the uppermost end thereof. The bottle 26 is of conventional construction and includes inwardly extending, metallic bellows 28. As best seen in FIG. 2, first contact pair 12 is disposed within vacuum bottle 26. Specifically, a fixed contact 30, and an elongated, shiftable contact 32 are positioned in axial alignment within the bottle 26, with the contact 32 being shiftable relative to contact 30 for closing and opening of the contact pair 12 during operation of tool 10.

Shiftable contact 32 includes an integral conductive segment 34 which extends outwardly from the bottle 26. A conductive sleeve 36 is partially telescoped over segment 34 and is fixed thereto. The sleeve 36 includes, at its lowermost end, a pair of axially spaced, radially outwardly extending lips 38, 40 which cooperatively define an annular space 42 therebetween. Also, an inwardly extending annular ledge 43 is also provided. A helical operating spring 44 is disposed about the segment 34 and sleeve 36, is captively retained between the base of vacuum bottle 26 and lip 38 (see FIG. 2), and serves to bias contact 32 to its open position. A compression spring 46 is disposed within sleeve 36, abuts the lowermost end of the segment 34, and serves to provide the needed pressure on the contacts 12. The force required to compress the spring 46 is considerably greater than that necessary to compress the outer spring 44, and the importance of this fact will be made clear hereinafter. An electrical contact 48, forming a part of second contact pair 14, is fixedly located within sleeve 36 adjacent the lowermost end thereof; hence, the shiftable contacts 32 and 48 of the respective pairs are interconnected and move in unison.

Figure 8:
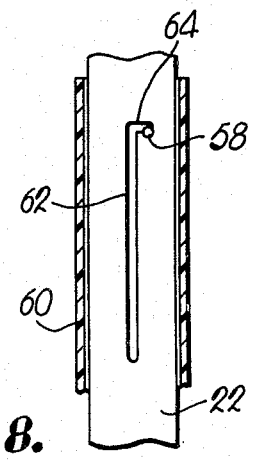
FIG. 8 is a fragmentary vertical sectional view illustrating the latching means provided with the tool.
Figure 3:
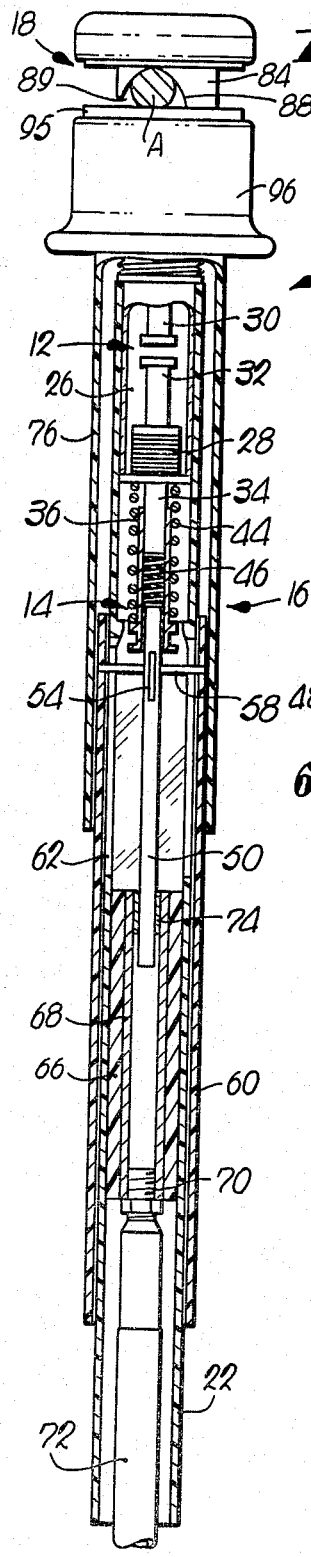
FIG. 3 is a view in partial vertical section similar to that of FIG. 2, but showing the tool during a load making operation.

Second contact pair 14 includes an elongated probe contact 50 having a rounded insertion end 52 which is designed for mating interengagement with the contact 48. The contact 50 is of substantial length and carries a pair of radially outwardly biased spring arms 54 each having an inwardly extending clip end 56. In addition, a transversely extending pin 58 extends through the contact 50. Pin 50 is in turn secured to an elongated second tubular member 60 so that the latter and contact move in unison. The member 60 is telescoped over the first tubular member 22 and is axially shiftable relative to the latter. Tube 22 is provided with a pair of opposed, elongated, axially extending slots 62 which receive and guide the respective ends of the pin 58. As best seen in FIG. 8, each slot 62 terminates in a circumferentially extending detent or latching region 64 which is important for purposes to be described.

A relatively thick synthetic resin tubular element 66 is disposed within the member 22 adjacent the lower portion of the probe contact 50. A metallic guide tube 68 is in turn telescoped within the element 66. The guide tube 66 is threaded at its lowermost end, as at 70, for receiving the correspondingly threaded end of an attaching conductor 72. The uppermost end of the tube 68 is provided with a contact 74 which remains in continuous engagement with the probe contact 50 during operation of tool 10.

An outermost, axially rotatable tubular member 76 is telescoped over the uppermost portions of the members 22 and 60, and includes a transparent portion corresponding and juxtaposed to that of the inner member 22.

Figure 6:
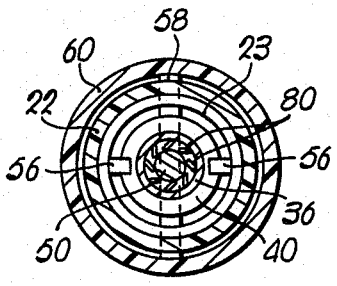
FIG. 6 is a sectional view taken along line 6—6 of FIG. 5.
Figure 7:
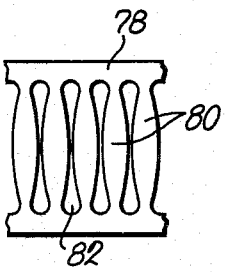
FIG. 7 is an enlarged, fragmentary elevational view illustrating one type of electrical contact used in the tool of the invention.

The contacts 48 and 74 are preferably of the so-called "multi-lam" type. Referring to FIG. 7, it will be seen that this type of contact comprises a tubular strip of conductive metallic material 78 having a series of axially extending, substantially flat contact surfaces 80 which are angularly disposed (see FIG. 6) relative to the circular orientation of the strip 78. The side-by-side surfaces 80 cooperatively define a series of openings 82 therebetween.

Connecting structure 18 includes a metallic, cavity-defining, cable-engaging section 84 having a circular flattened head 86, a rounded cavity-defining wall 88 extending transversely therethrough and presenting a conductor-receiving cavity 89, and a depending threaded portion 90. As best seen in FIG. 2, the uppermost end of tubular member 22 is fixedly secured to the lowermost end of the portion 90. Furthermore, fixed contact 30 is threaded into an appropriate bore 92 provided in the butt end of the portion 90. An axially shiftable cup 94 is threaded onto the portion 90 and can be advanced or retracted therealong. The cup 94 carries an uppermost metallic contact washer 95. Outermost tubular member 76 is fixedly secured to the cup 94 such that rotation of the member 76 correspondingly rotates the cup. Finally, an outermost insulative guard 96 is secured to the outermost surface of the cup 94 for rotation therewith.

Connecting structure 20 includes the elongated attaching conductor 72 (which is secured to tube 70 well within the confines of member 22 for reasons of safety), as well as conventional jaw type conductor connector 98 having a metallic jaw 100 and a metallic, shiftable clamping element 102 for connection of the connector 98 to a conductor.

Figure 9:
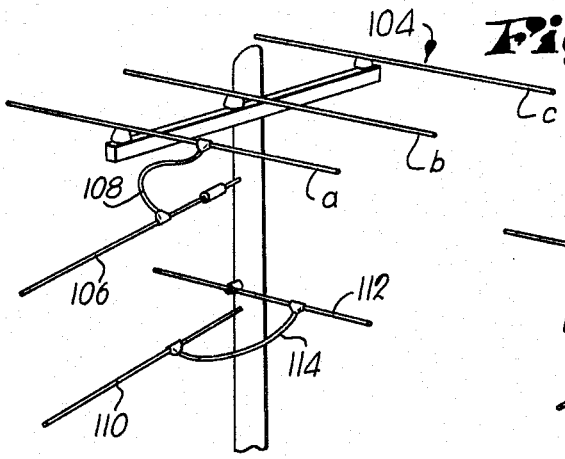
FIGS. 9–13 illustrate the sequence of operation using the tool of the invention to change an electrical distribution spur line under load from one conductor of a three phase set thereof to another conductor of the set.
Figure 10:
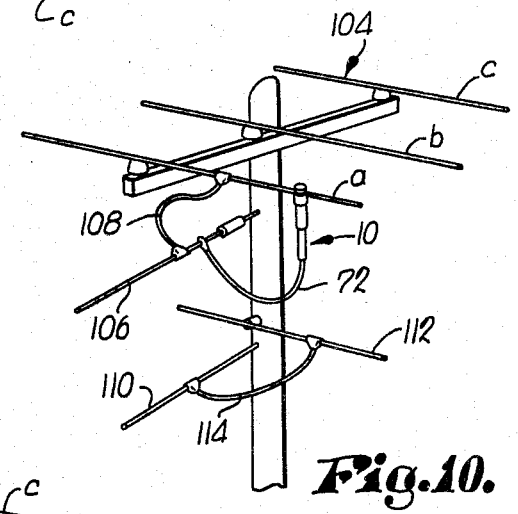

The use of tool 10 will now be described with reference to the exemplary situation illustrated in FIGS. 9–13. Specifically, FIG. 9 illustrates a common situation wherein a set of phase conductors 104 having phase lines a, b and c are provided, along with a spur conductor 106. A short stretch of conductor 108 extends between the "a" line of set 104 and spur 106. A similar arrangement is presented between the neutral 110 for the spur, the neutral 112 for the phase set 104, and short conductor 114. If, for example, it is desired to shift conductor 108 from phase line "a" to phase line "b", it has heretofore been necessary to deenergize the system upstream of the connection to spur 106, inasmuch as a portable load making and breaking tool useful in this connection has not been available. However, the present invention overcomes this difficulty and allows quick and easy changeover without the necessity of widespread outages.

Figure 4:
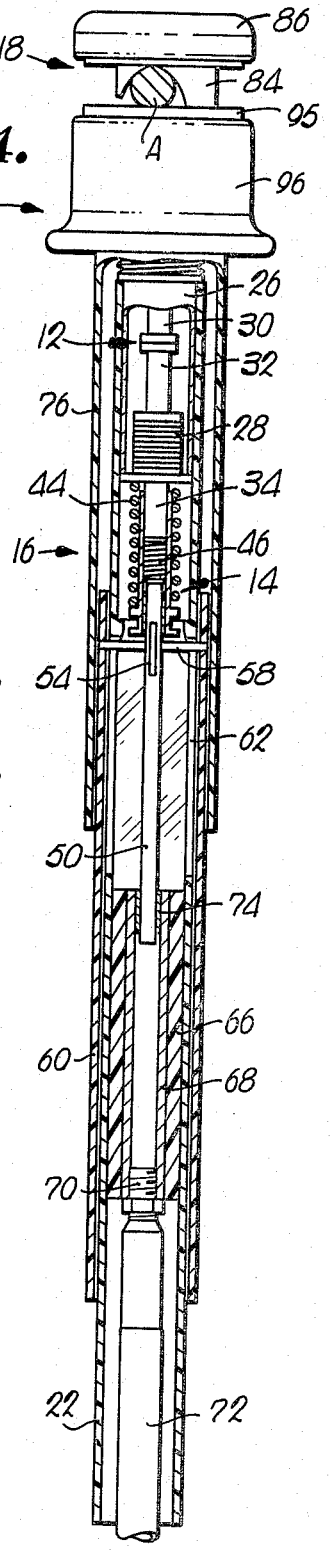
FIG. 4 is a view similar to that of FIG. 3, but showing the tool in a full load making position.

The first step in such a changeover would be to attach the tool 10 of the present invention in parallel with the conductor 108. This can be accomplished with both of the contact pairs 12 and 14 closed (see FIG. 4); however, the safest procedure is to attach the tool in its open position (FIG. 2) and close the tool after such connection. Initial attachment is accomplished in the following manner. First of all, the user grasps outer tubular element 76 and axially rotates the latter for screwing the cup 94 and its associated contact washer 95 down the length of the threaded portion 90. This serves to create an adequate clearance between the uppermost margin of the washer 95 and cavity defining wall 88. At this point the uppermost end of tool 10 is suspended from the "a" phase line by maneuvering the tool in such manner to position the latter within the transversely extending cavity 89. The tubular member 76 is thereupon rotated in an opposite direction to thread the cup 94, and thereby the contact washer 95, into engagement with the "a" conductor until the latter is pressed between the wall 88 and the upper margin of the washer 95 such that the good electrical contact is established. The remaining end of tool 10 is then secured to the line 110 simply by attaching the connector 98 in the conventional manner to the spur. Thus, in this initial orientation, the conductor 108 and tool 10 are connected in parallel between the "a" phase line and spur 110.

Figure 5:
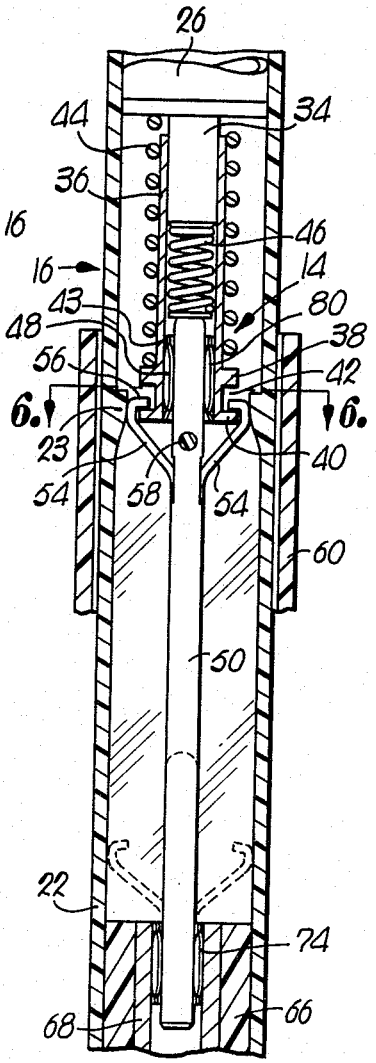
FIG. 5 is an enlarged, fragmentary vertical sectional view illustrating the operating mechanism of the tool.

The load making operation of tool 10 is next initiated. Specifically, the user grasps the member 60 and axially shifts the same upwardly until the pin 58 approahes the regions 64, whereupon the member 60 is rotated axially to move the pin 58 to the latching position thereof illustrated in FIG. 8. During this sequence, the probe contact 50 is shifted upwardly with the member 60 and first engages and shifts into the multi-lam contact 48. This shifting continues, without producing significant closing motion of the tube 36, until contact 50 engages the end of spring 46. At this point, spring 46 pushes extension 34 upwardly as viewed in FIG. 5, carrying tube 36 upwardly and compressing spring 44. Upon engagement of contacts 12, continued shifting of contact 50 to the fully closed position thereof further compresses spring 44, and develops the needed contact pressure through spring 46. Additionally, the radially inwardly extending shoulder 23 on the member 22 serves to guide the clip ends 56 of the arms 54 into the annular space 42, so that the device assumes the closed position illustrated in FIGS. 4 and 5. It will also be noted that during the load making operation the second contact pair 14 is closed first, whereupon the contact pair 12 within vacuum bottle 26 is closed. Thus, actual load making occurs when the contact pair 12 closes; and because the latter is disposed within the vacuum bottle 26, any tendency to arc between the contacts 30, 32 is minimized.

In the closed position of tool 10, a conductive path is established between the section 84, contact 30, 32, segment 34, sleeve 36, contact 48, contact 50, contact 74, guide tube 68, connection 70, conductor 72, and finally the connector 98. Of course, the tool is positively latched against opening because of the seating of the pin 58 within the regions 64 of the slots 62.

Figure 11:
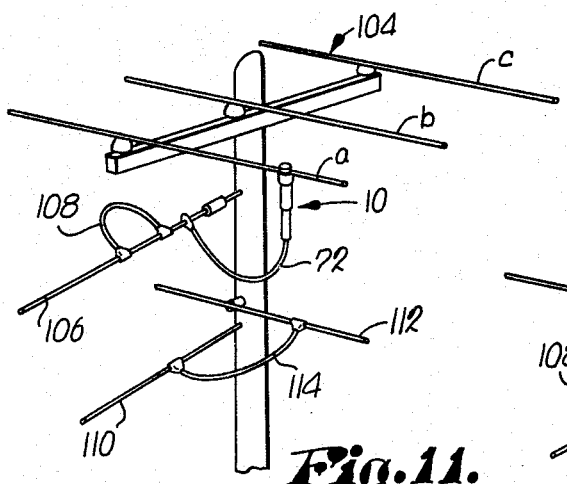

The next step of the operation is to disconnect conductor 108 from the "a" phase line (see FIG. 11). This can be accomplished without arcing inasmuch as tool 10 is in parallel with the conductor 108. At this point the tool 10 provides the sole electrical connection between the "a" phase line and the spur 106.

Tool 10 is next used to break the load between the "a" phase line and spur 106. This is accomplished simply by grasping the tubular member 60 and rotating the same in an axial direction so as to move the pin 58 from the latching region 64 and into the elongated slot 62. At this point spring 46 extends until the face thereof engages and seats against ledge 43. The residual compression of spring 46 now no longer exerts pressure on the contacts 12. As contact 50 is further withdrawn, spring 44 comes into play, causing the lower face of spring 46 to follow contact 50 and tube 36 downwardly, thereby opening contacts 12. This continues until tube 36 has reached the end of its travel. Still further withdrawal of contact 50 clears contact 48.

Friction between the contacts 50, 48 during the opening sequence may tend to pull tube 36 open before securing of spring 46 against ledge 43. However, this is unimportant because the contacts 12 still open properly. As noted, the contacts 12 open first and actually break the load. By virtue of the fact that the contact pair 12 is disposed within the vacuum bottle 26, very little arcing occurs during the rapid load-breaking sequence, and therefore an extremely safe and reliable operation is assured.

The downward movement of tubular member 60 is continued until the pin 58 bottoms out against the ends of the slots 62 (see FIG. 2). In this orientation, the nontransparent member 60 is withdrawn from between the transparent portions of the members 22 and 76; accordingly, the user can visually perceive a large air gap between the secondary contacts 48 and 50.

It will also be noted that in the orientation of device 10 wherein the contacts are closed, the inwardly extending clip ends 56 of the arms 54 are disposed within the space 42 between the lips 38 and 40. As a consequence, a downwardly extending, positive pulling action is provided on the sleeve 36 and the components connected thereto during the load breaking sequence, so as to further facilitate smooth load breaking even in the event that the contacts 30, 32 become welded together, as can occur.

Figure 12:
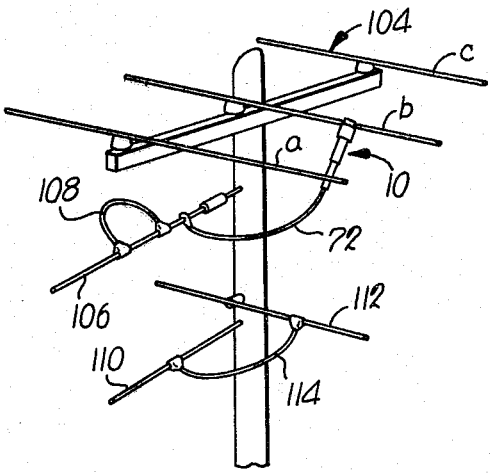
Figure 13:
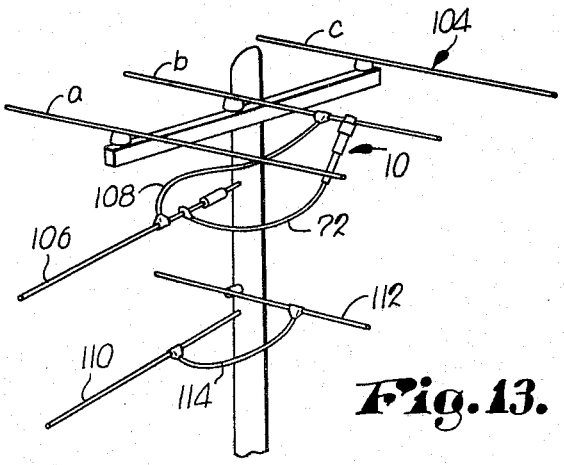

With the load between the "a" phase conductor and spur 106 broken, it is now possible to shift the tool 10 to the "b" phase line (see FIG. 12). This involves simply removing the tool from the "a" line and reattaching the same to the "b" line in the manner described above, i.e., by proper rotation and counterrotation of the member 76. At this point, of course, there is no load established between the "b" phase line and spur 106.

The tool 10 is thereafter closed in a manner identical to that described above to close the circuit between spur 106 and the "b" phase line.

After the final load making operation has been completed, it is only necessary to attach conductor 108 to the "b" phase line (FIG. 13), whereupon the tool 10 and conductor 108 are again in parallel. At this point tool 10 can simply be completely removed without fear of arcing.

It will thus be seen that the present invention provides a truly portable load making and breaking device of universal applicability (it being noted that the tool could be placed in parallel with switchgear or cutouts if desired) and extreme reliability and safety in operation.

Having thus described the invention, what is claimed as new and desired to be secured by Letters Patent is:

1. A portable tool for making and breaking load currents, comprising:

a first pair of electrical load-making and breaking contacts, at least one of said contacts of said first pair being shiftable relative to the other contact thereof for closing and opening of the first contact pair;

a second contact pair, at least one of the contacts of said second contact pair being shiftable relative to the other contact thereof for closing and opening of the second contact pair;

means for electrically connecting said first and second contact pairs in series;

mechanism for breaking a load current passing through said contact pairs, when both of the latter are closed, by sequentially opening said first contact pair and thence opening said second contact pair, and for making a load current through said contact pairs, when both of the latter are open, by sequentially closing said second contact pair and thence closing said first contact pair, said mechanism including structure operatively interconnecting the shiftable contact of said first pair thereof, and a shiftable contact of said second pair thereof, for movement of the interconnected contacts in unison;

means for biasing said interconnected contacts in a direction for opening the first contact pair;

means for selectively shifting the free contact of said second pair thereof in a direction, when both of said contact pairs are open, for engaging the interconnected contact of said second pair and closing the latter, overcoming the bias of said biasing means, and shifting the shiftable contact of said first pair into operative engagement with the remaining contact of the first pair for closing the latter, and alternatively in a direction, when both of said contact pairs are closed, for opening of said first and second contact pairs, said shifting means comprising an elongated first tubular member enclosing said first and second contact pairs, an outer second tubular member telescoped over said first member and axially shiftable relative to the latter, and means operatively interconnecting said outer tubular member and said free contact of said second pair thereof for axial reciprocation of the latter within said first tubular member in response to corresponding reciprocation of said second tubular member;

means for selectively and releasably latching said contact pairs in a closed condition, said biasing means being constructed and arranged for exerting sufficient biasing force on said interconnecting contacts such that when both of said contact pairs are open and the free contact of said second pair is shifted toward the interconnected contact of the second pair, said second contact pair is initially closed whereupon said first contact pair is closed for making a load current path through said contact pairs, and such that, when both of the said contact pairs are closed and said latching means is released, said interconnected contacts are initially shifted under the influence of said biasing means to thereby open said first contact pair, whereupon additional shifting of said free contact of said second pair thereof serves to open said second contact pair;

means for suppressing arcing between said first contact pair during said closing and opening thereof; and means for temporarily electrically connecting both of said series-connected contact pairs between a pair of conductors.

2. The tool as set forth in claim 1 wherein said arc-suppressing means comprises structure surrounding said first contact pair and defining a vacuum chamber therewithin.

3. The tool as set forth in claim 1 including structure permitting visual observation of an open condition between said second pair of contacts.

4. The tool as set forth in claim 1 wherein the portion of said first tubular wall adjacent said second contact pair is transparent for viewing of a visible gap between the contacts of the second pair.

* * * * *

UNITED STATES PATENT AND TRADEMARK OFFICE

CERTIFICATE OF CORRECTION

PATENT NO. : 4,281,228

DATED : Jul. 28, 1981

INVENTOR(S) : Robert W. Harmon

It is certified that error appears in the above-identified patent and that said Letters Patent are hereby corrected as shown below:

On the front page of the patent document the following should be added:

Assignee: A. B. CHANCE COMPANY, Centralia, Mo.

Signed and Sealed this

*Seventeenth* Day of *November 1981*

[SEAL]

*Attest:*

GERALD J. MOSSINGHOFF

*Attesting Officer*

*Commissioner of Patents and Trademarks*